US005343594A

United States Patent [19]

Harvey

[11] Patent Number: 5,343,594

[45] Date of Patent: Sep. 6, 1994

[54] CORNER ROLLER ARRANGEMENT FOR SLIDING PANELS

[75] Inventor: Daniel H. Harvey, Placentia, Calif.

[73] Assignee: Metal Industries, Inc., Elizabethville, Pa.

[21] Appl. No.: 53,413

[22] Filed: Apr. 28, 1993

[51] Int. Cl.[5] ..... A47H 15/00; E05D 15/06

[52] U.S. Cl. ..... 16/105; 16/91

[58] Field of Search ..... 16/91, 105

[56] References Cited

U.S. PATENT DOCUMENTS 3,959,849 6/1976 Marquardt ..... 16/105

4,253,278 3/1981 Dallaire ..... 16/105

5,119,872 6/1992 Engebretson ..... 16/105

FOREIGN PATENT DOCUMENTS 484257 11/1929 Fed. Rep. of Germany ..... 16/91

*Primary Examiner*—Carmine Cuda

*Attorney, Agent, or Firm*—Anthony F. Cuoco

[57] ABSTRACT

A sliding panel includes top, bottom and side members. A corner roller arrangement has integral corner keys, whereby a corner member abuts the ends of the panel members at each of the corners thereof. Each of the corner members includes a spring biased roller whereby the rollers are self-leveling at each of said corners. A clip is arranged to adjust the roller to a plurality of inwardly and outwardly extensions relative to the top and bottom panel members. The arrangement is such that the corner members are effective as an installation guide for the sliding panel and impart an anti-rattle feature thereto.

7 Claims, 2 Drawing Sheets

CORNER ROLLER ARRANGEMENT FOR SLIDING PANELS

BACKGROUND OF THE INVENTION

It is usual in the prior art to provide sliding panels, such as screen or glass doors and the like, with rollers at the corners of the panels. The rollers ride on appropriate tracks on the top and bottom of the door opening. It is also usual in the prior art for the rollers to be spring biased so as to permit the door to be positioned in the tracks by a simple manipulation and to permit the doors to be easily removed from the tracks as may be required. It is important that the rollers be self-adjustable so that they can ride freely in the tracks and thus avoid binding of the panel in the tracks as the panel slides from one position to another, and to accommodate slight variations in the size of the panel opening and/or out of square conditions, imperfections, etc. which may exist in said opening. Moreover, the rollers should be displaceable to various positions away from the top and bottom edges of the door and should be easily replaceable. Preferably, the corners of the door should be configured so as to act as an installation guide and to have anti-rattle characteristics.

The following prior art relates generally to the invention disclosed herein: U.S. Pat. No. 3,299,575 (U.S. Class 49/420) which issued to Du Shane on Jan. 24, 1967; U.S. Pat. No. 3,716,890 (U.S. Class 16/91) which issued to Benson on Feb. 20, 1973; U.S. Pat. No. 3,030,654 (U.S. Class 16/91) which issued to Migneault, et al, on Apr. 24, 1962; U.S. Pat. No. 4,873,741 (U.S. Class 16/105) which issued to Riegelman on Oct. 17, 1989; and U.S. Pat. No. 3,619,947 (U.S. Class 49/425) which issued to Burum, et al, on Nov. 16, 1971.

U.S. Pat. No. 3,299,575 relates to a screen frame construction of sheet metal or extruded members for sliding screen doors having supporting rollers at the bottom and guide rollers at the top of the frame. The patent generally teaches rollers having a spring biased wheel and an adjustment screw, as particularly shown in FIG. 1 of the patent.

U.S. Pat. No. 3,716,890 relates to a sliding door roller assembly comprising a unitary generally L-shaped corner bracket having a pivotable roller carriage with an outwardly biased detent engageable in a groove in a flange of the corner bracket. A biasing spring and an adjustment screw are also featured.

U.S. Pat. No. 3,030,654 relates to a pressure applying device for applying sealing pressure to closure panels such as windows, doors and the like. The invention recognizes that in sliding panel construction for building structures, it is desireable to provide means for resiliently urging the panel into snug fitting engagement with a wall of the groove in which it is slidably mounted in order to prevent the occurrence of drafts and to avoid rattles and the like. To this extent, the invention teaches a roller arrangement having an outward biasing spring and an adjustment screw, as particularly shown in FIG. 1.

U.S. Pat. No. 4,873,741 relates to sliding door roller apparatus including an easily replaceable and removable wheel assembly. The wheel assembly includes a resilient housing, a wheel and an axle on which the wheel turns. The resilient housing is a part of opposite facing side walls each having an integral end portion that extends toward and overlaps the other. Each end portion includes at least one locking finger that is positionable within an opening on the holding member. The resiliency of the housing permits the locking fingers to be placed or removed from an opening located on the holding member. An adjustment mechanism including a biasing spring and an adjustment means is provided.

U.S. Pat. No. 3,619,947 relates to a one-piece corner fastener for securing together the stile and rail of a sliding door frame. The corner fastener is made of plastic and has an integral roller carrying arm with sufficient resiliency to yieldingly hold the roller in engagement with a door frame guiding track. Adjustable stop means limit the extent of movement of the roller away from the door frame guiding track.

It will be discerned from the description of the present invention which follows that the invention differs structurally from the prior art as recited above and provides a corner roller arrangement for sliding panels not taught or suggested thereby and which provides the aforementioned advantageous features.

SUMMARY OF THE INVENTION

This invention contemplates a corner roller arrangement for sliding panels of the type including a pair of parallel, elongated spaced side members and top and bottom parallel members. The ends of the top and bottom members and the ends of the side members fit over corner keys integral with corner members, and which top, bottom and side members abut the corner members at each of the panel corners. Each of the corner members includes a frame and a roller housing which rotatably supports a roller. The roller housing is spring biased within the frame and extends outwardly therefrom, whereby the rollers are self-leveling at each corner of the panel. A clip is secured to the frame and is in cooperative arrangement with the roller housing for adjusting the extension of the roller inwardly and outwardly from the frame, and for preventing the roller housing from dropping out of the frame.

DETAILED DESCRIPTION OF THE INVENTION

Figure 1:
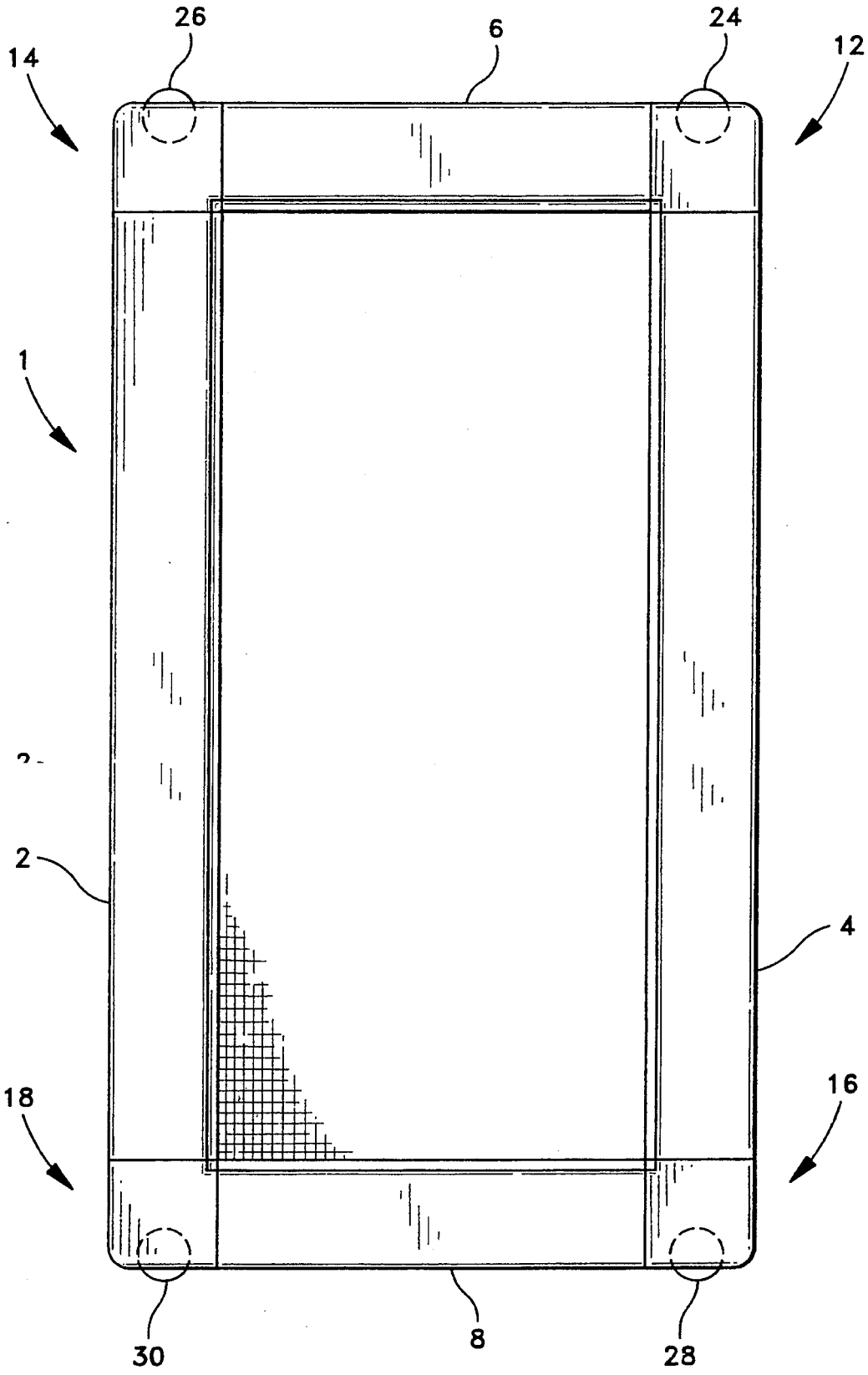
FIG. 1 is a front elevational view showing a sliding panel and generally showing corner roller arrangements therefor in accordance with the invention.
Figure 2:
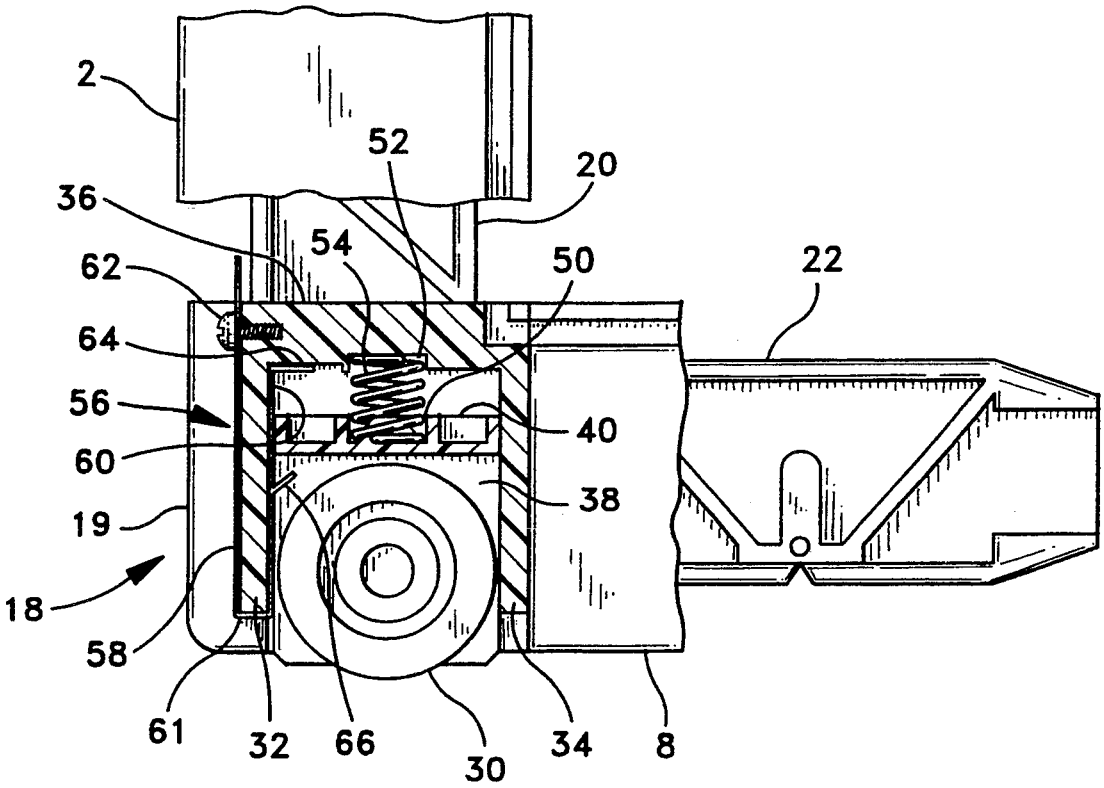
FIG. 2 is a partially sectioned diagrammatic representation illustrating in substantial detail one of the corner roller arrangements generally shown in FIG. 1, with all of said roller arrangements being structurally the same.

With reference to FIG. 1, a sliding panel is designated generally by the numeral 1. Sliding panel 1 may be a screen door or a glass door or the like and is shown for purposes of illustration as a screen door. Sliding panel 1 is of the type which is fixed within an opening in a wall of a building (not otherwise shown) to provide access to porches, patios and other building areas. To this extent, the panel includes a rigid frame including a pair of parallel, elongated, spaced side members 2 and 4 defining the length of the panel and top and bottom parallel members 6 and 8, respectively, defining the width of the panel secured to side members 2 and 4 at the ends thereof through top corner members 12 and 14 and bottom corner members 16 and 18 including frames such as 19 and corner keys such as 20 and 22 integral therewith (FIG. 2). In this regard, and with reference to FIG. 2, the top and bottom members of the door such as 8 and the side members thereof such as 2 fit over the corner keys such as 20 and 22 and abut the corner member frames such as 19 as will be readily discerned.

Reference will now be made particularly to FIG. 2 wherein corner member 18 will be described in substantial detail. It will be understood that corner members 12, 14 and 16 are of like configuration and the description of corner member 18 applies to the other corner members as well.

Corner member 18 having frame 19 and corner keys 20 and 22 integral therewith is fabricated as by molding or the like from a suitable plastic material such as, for purposes of example, an acetal plastic as are corner members 12, 14 and 16 (FIG. 1). Side and bottom members 2 and 8 of panel 1 are fabricated from a suitable metallic material such as, for purposes of example, aluminum as are side and top members 4 and 6 (FIG. 1).

Frame 19 receives a roller housing 38 which rotatably supports a plastic roller 30 in a manner as will be hereinafter described with reference to FIG. 3.

With continued reference to FIG. 2, frame 19 has a pair of parallel sides 32 and 34 and a top 36. Side 32 is an outward side and side 34 is an inward side, with said sides being in spaced relation. Roller housing 38 is received within frame 19 between sides 32 and 34 so as to be displaceable therewithin.

Figure 3:
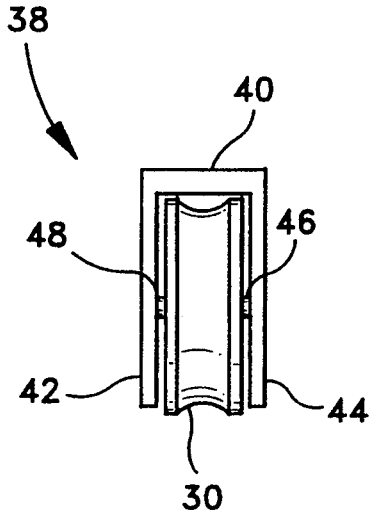
FIG. 3 is a side elevational view showing a roller housing and a roller rotatably supported thereby included in the corner roller arrangement shown in FIG. 2.

Roller housing 38 is configured as a yoke-like member as particularly shown in FIG. 3. The roller housing is fabricated of the aforementioned plastic material and has a top 40 and sides 42 and 44. Each of the sides 42 and 44 carries an integral pin or the like such as 46 and 48 which engage holes (not otherwise shown) in roller 30 and cooperatively function as an axle for the roller, whereby the roller is rotatably supported within roller housing 38.

As particularly shown in FIG. 2, top 40 of roller housing 38 has an inwardly extending well 50. Top 36 of frame 19 which is in longitudinally spaced relation with roller housing top 40 has an inwardly extending well 52 in alignment with well 50. A spring 54 is disposed within wells 50 and 52 and is effective for spring biasing roller housing 38 rotatably supporting roller 30 for purposes which will hereinafter be described.

A generally U-shaped metallic clip is designated by the numeral 56 and has a longitudinally extending outward leg 58, a shorter longitudinally extending inward leg 60 and a base 61. Legs 58 and 60 are spaced apart so that the legs and clip base 61 fit over and around side 32 of frame 19. Leg 58 of clip 56 is secured to side 32 of frame 19 via a screw or the like 62, the same to be hereinafter more fully described with reference to FIG. 4.

Leg 60 of clip 56 includes in longitudinal spaced relation an inwardly extending ledge 64 and an inwardly extending lip 66. The extension of roller housing 38 inwardly and outwardly of frame 19 via the biasing of spring 54 is limited by the space between ledge 64 and lip 66. That is to say, the inwardly extension of roller housing 38 is limited when top 40 thereof abuts ledge 64 as shown in FIG. 2, and the outwardly displacement thereof is limited when top 40 abuts lip 66.

Figure 4:
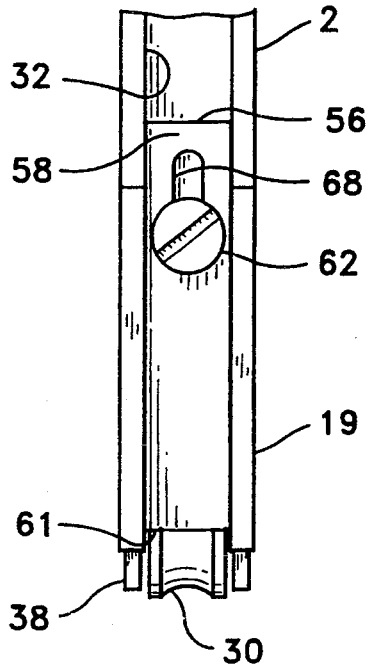
FIG. 4 is a side elevational view showing one end of one of the parallel sides of the sliding panel and showing an adjustment clip supported so as to be in cooperative arrangement with the roller housing as shown in FIG. 2.

In this regard, reference is made to FIG. 4. Clip 56 is arranged to be adjustably secured to leg 32 of frame 19 via an elongated slot 68 in leg 58 of clip 56. Side 32 of frame 19 has a hole (not otherwise shown) whereby, when clip 56 is longitudinally adjusted, slot 68 in clip leg 58 aligns with the hole in the frame side for receiving screw 62, whereby the extension of roller housing 38 within and without frame 19 is adjustable, as will now be discerned.

It will be noted that the inward extension of roller housing 38 is limited by ledge 64 and the outward extension thereof is limited by lip 66. Lip 66 has the further function of preventing roller housing 38 from dropping out of frame 19, as will now be discerned. With the arrangement described, an adjustability feature, i.e. a self-leveling feature is imparted to roller 30, and likewise to rollers 24, 26 and 28 at the corners of panel 1.

There has thus been described a corner roller arrangement for sliding panels wherein the corner keys for the panels are integral with the corner roller members. The rollers are individually spring biased for self-leveling at each corner of the screen. A clip is in cooperative arrangement with a roller housing for permitting extension of the roller housing to various positions. The width of the corner members allows said members to function as a guide for installation in a panel opening and since said members are of a plastic material, an anti-rattle feature is incorporated into the arrangement. Moreover, each of the rollers is easily replaceable as the rollers wear out, as is distinctly advantageous.

With the above description of the invention in mind, reference is made to the claims appended hereto for a definition of the scope of the invention.

What is claimed is:

1. A corner roller arrangement for each of the corners of a sliding panel of the type including a pair of parallel, elongated spaced side members defining the length of the panel and top and bottom members defining the width of the panel, said corner roller arrangement comprising:

a corner member including a frame, and having corner keys integral therewith, the corner keys fitting into the side, top and bottom panel members whereby said panel members abut the corner member frame for providing a rigid panel frame;

a roller housing rotatably supporting a roller and displaceably disposed within the corner member frame;

the corner member frame having an inward side and an outward side, said inward and outward sides being in substantially parallel spaced relation, and the roller housing being displaceably disposed between the inward and outward corner member frame sides;

means cooperatively arranged with the corner member frame and with the roller housing for supporting a biasing spring therebetween, whereby said roller housing is biased for displacement inwardly and outwardly of the corner member frame; and means cooperatively arranged with the corner member frame and with the roller housing for adjustably limiting said displacement including a generally U-shaped clip having an outward leg, an inward leg and a base, said outward and inward legs and said base fitting over and around the outward side of the corner member frame, the outward leg of the U-shaped clip being adjustably secured to the outward side of the corner member frame, the inward leg of said clip having an inwardly extending ledge and an inwardly extending lip in longitudinal spaced relation, the inwardly displacement of the roller housing being limited when the top member of said roller housing abuts the inwardly extending ledge, and the outwardly displacement of the roller housing being limited when the top member of said roller housing abuts the inwardly extending lip.

2. A corner roller arrangement as described by claim 1, wherein:

the corner member including the frame, and having corner keys integral therewith, is of a plastic material; and the roller housing is of a plastic material.

3. A corner roller arrangement as described by claim 1, wherein the means cooperatively arranged with the corner member frame and with the roller housing for supporting a biasing spring therebetween includes:

the corner member frame having a top member with a well disposed therein;

the roller housing having a top member in longitudinal spaced relation with the top member of the corner member frame, and said roller housing having a well disposed therein in alignment with the well in the top member of the corner member frame; and the biasing spring being disposed within the wells of the top members of the corner member frame and the roller housing.

4. A corner roller arrangement as described by claim 1, including:

the outward leg of the clip having a slot;

the outward side of the corner member frame having a hole;

the slot in the outward clip leg being longitudinally aligned with the hole in the outward corner member frame side; and means engaging said longitudinally aligned slot and hole for securing the outward leg of the clip to the outward corner member frame side, whereby the displacement of the roller housing is adjustably limited.

5. A corner roller arrangement for each of the corners of a sliding panel, comprising:

a corner member including a frame having an inward side and an outward side, said inward and outward sides being in substantially parallel spaced relation;

a roller housing rotatably supporting a roller and displaceably disposed between the inward and outward corner member frame sides;

means cooperatively arranged with the corner member frame and with the roller housing for supporting a biasing spring therebetween, whereby said roller housing is biased for displacement inwardly and outwardly of the corner member frame;

the corner member frame having a top member with a well disposed therein;

the roller housing having a top member in longitudinal spaced relation with the top member of the corner member frame, and said roller housing having a well a disposed therein in alignment with the well in the top member of the corner member frame;

the biasing spring being disposed within the wells of the top members of the corner member frame and the roller housing; and means cooperatively arranged with the corner member frame and with the roller housing for adjustably limiting said displacement including a generally U-shaped clip having an outward leg, an inward leg and a base, said outward and inward legs and said base fitting over and around the outward side of the corner member frame, the outward leg of the U-shaped clip frame, the inward leg of said clip having an inwardly extending relation, the inwardly displacement of the roller housing being limited when the top member of said roller housing abuts the inwardly extending ledge, the outwardly displacement of the roller housing being limited when the top member of said roller housing abuts the inwardly extending lip.

6. A corner roller arrangement as described by claim 5, including:

the outward leg of the clip having a slot;

the outward side of the corner member frame having a hole;

the slot in the outward clip leg being longitudinally aligned with the hole in the outward corner member frame side; and means engaging said longitudinally aligned slot and hole for securing the outward leg of the clip to the outward corner member frame side, whereby the displacement of the roller housing is adjustably limited.

7. A corner roller arrangement as described by claim 5, wherein:

the corner member frame and the roller housing are of a plastic material.

* * * * *